US006935407B2

(12) United States Patent
Shikata et al.

(10) Patent No.: US 6,935,407 B2
(45) Date of Patent: Aug. 30, 2005

(54) CASTING APPARATUS

(75) Inventors: Kunio Shikata, Osaka (JP); Yoshiaki Komuro, Osaka (JP); Masayuki Ono, Osaka (JP); Kumiko Kurohara, Osaka (JP); Hideo Ishii, Osaka (JP)

(73) Assignee: Sansha Electric Manufacturing Company, Limited, Osaka (JP)

( * ) Notice: Subject to any disclaimer, the term of this patent is extended or adjusted under 35 U.S.C. 154(b) by 1 day.

(21) Appl. No.: 10/360,359

(22) Filed: Feb. 7, 2003

(65) Prior Publication Data

US 2004/0154781 A1 Aug. 12, 2004

(51) Int. Cl.[7] ..... B22D 37/00
(52) U.S. Cl. ..... 164/155.6; 164/457
(58) Field of Search ..... 164/155.1, 154.6, 164/155.6, 457

(56) References Cited

U.S. PATENT DOCUMENTS 4,796,688 A 1/1989 Gundlach et al.
6,250,367 B1 * 6/2001 Komuro et al. ..... 164/155.6
6,505,675 B2 * 1/2003 Komuro et al. ..... 164/155.6

FOREIGN PATENT DOCUMENTS

JP 11-285811 * 10/1999

* cited by examiner

*Primary Examiner*—Kuang Y. Lin
(74) *Attorney, Agent, or Firm*—Duane Morris LLP

(57) ABSTRACT

A casting apparatus has a melting pot (4) in which pieces of metal (8) to be melted is placed. A RF induction heater coil (10) is disposed in association with the melting pot (4) to heat the metal pieces (8). An inverter (18) supplies the coil (10) with high-frequency power to melt the metal pieces (8) in the melting pot (4), and the resulting molten metal is poured into a die (6). A control unit (36), after all of the metal pieces (8) having various sizes and shapes are melted, causes the operation of the inverter (18) to continue for a first time period and, after that, to suspend the operation of the inverter (18) for a second time period so that the heating can be stopped. After that, the control unit (36) causes the inverter (18) to resume its operation to heat the melted metal (8) in the melting pot (4) until the molten metal (8) assumes a predetermined state and, a third predetermined time after that, operates a melting pot driver (9) to cause the molten metal (8) to be poured into the die (6).

4 Claims, 3 Drawing Sheets

CASTING APPARATUS

This invention relates to a casting apparatus for casting small-sized articles, such as false teeth and accessories.

BACKGROUND OF THE INVENTION

Casting is a technique of melting metal and pouring the molten metal into a die to thereby produce desired articles. Each metal has its own proper timing at which it should be poured into a die. If the molten metal is poured at a time earlier than the right time for that metal, the molten metal will not spread to corners of a cavity in the die because of its high viscosity, which prevents precise manufacturing of aimed articles. If, on the contrary, the molten metal is poured too late, its temperature becomes so high that the molten metal may be evaporated off, oxidized, or have its composition modified. Sometimes, molten metal at high temperature may stick to a die. Thus, the quality of cast articles depends greatly on the pouring time.

An exact pouring timing has correlation with the surface temperature of molten metal. It has been proposed to determine the timing for pouring molten metal into a die, based on the surface temperature of the molten metal measured by an infrared thermometer. However, the thermal infrared emissivity differs from metal to metal, and the emissivity of a particular metal changes from time to time because the surface state of molten metal changes during melting. Furthermore, when the metal melts and its viscosity begins to decrease, parts of surface films such as metal oxide films over the surface of the molten metal may float and drift on the surface of the molten metal. This causes irregular changes in infrared emissivity of the molten metal surface. Some metals may absorb infrared radiation when they evaporate or generate gas. Because of these factors, it is not easy to accurately measure the surface temperature of molten metal with stability.

The assignee of the present U.S. patent application filed Japanese Patent Application No. 2000-60845 on Mar. 6, 2000 which was laid open for public inspection under Japanese Patent Application Publication No. 2001-252758, and from which U.S. Pat. No. 6,505,675 entitled "Molten Metal Pouring Time Determining Apparatus" and issued on Jan. 14, 2003 claimed a priority date. One of the co-inventors of the U.S. patent is one of the co-inventors of the present application. What was disclosed in the Japanese application was a casting apparatus in which metal placed in a melting pot is melted by applying a high-frequency signal modulated with a low-frequency signal, and a light receiver receives light emitted by the metal in the melting pot. Since the melting of metal is carried out by means of a high-frequency signal modulated with a low-frequency signal, the molten metal vibrates in accordance with the low-frequency signal, which results in a corresponding vibrating component developed in a received-light representative signal developed by the light-receiver. The molten metal is poured into a die when the vibrating component exceeds a reference value.

In casting, unused metal is not always used solely, but unused metal is sometimes used together with metal pieces removed from a cast article with an oxide film formed thereon. In such case, the oxide film may float and move to vibrate on the surface of the molten metal, and, therefore, an accurate metal temperature cannot be determined. In other case, different-sized metal pieces are melted together. In such case, it may occur that although smaller metal pieces have melted, larger ones have not. The molten metal mass of the smaller pieces may cause the vibrating component in the received-light representative signal to exceed the reference value. Also, at the time when the molten metal mass resulting from continuous heating of the larger pieces after the smaller ones have been melted is poured into a die, part of the molten metal may be evaporated or oxidized, or the molten metal composition may change. In addition, the molten metal poured into the die may stick to the die.

An object of the present invention, therefore, is to provide a casting apparatus with which molten metal can be poured into a die at a time determined on the basis of a true temperature of the molten metal, even when different-sized pieces of metal are used or a metal piece with an oxide film formed on it is used as a starting material.

SUMMARY OF THE INVENTION

A casting apparatus according to one embodiment of the present invention has a melting vessel in which metal to be melted is placed. The metal to be placed in the melting vessel may consist of metal pieces of different sizes. In other case, a metal piece with an oxide film formed thereon may be placed in the melting vessel together with a metal piece without an oxide film thereon. Heating means is used in association with the melting vessel to heat the metal in the melting vessel. The heating is, for example, resistance heating or induction heating. The metal melted by heating with the heating means is poured into a die. The melting vessel has an arrangement for pouring molten metal into the die. A control unit controls components of the casting apparatus including the heating means and the melting vessel. The control unit causes the heating means to operate to melt the metal in the melting vessel. After that, the control unit causes the heating means to suspend its operation, then, causes the heating means to resume its operation after a predetermined time, and, then, causes the molten metal in the melting vessel to be poured into the die.

Let it be assumed that a plurality of metal pieces of different sizes are placed in the melting vessel of the casting apparatus with the above-described arrangement. In such case, smaller pieces of metal may be melted first to a state suitable for pouring into the die, while molten metal resulting from the larger pieces have not yet been in a state suitable for pouring. If the pouring takes place at this stage, the molten metal poured into the die is not in an optimum state. On the other hand, if the heating is continued until the molten metal resulting from the larger pieces is melted to the state suitable for pouring, the molten metal resulting from the smaller pieces may at least partly be evaporated or oxidized or have its composition changed. According to the present invention, both the larger and smaller pieces of metal are heated to melt, and the molten metal masses resulting therefrom mix with each other into a single mass of molten metal. Since, at this stage, the temperature of the molten metal may be highly probably higher than the optimum pouring temperature suitable for pouring, neither pouring is carried out, nor the heating is continued, but the heating is suspended, whereby the temperature of the entire molten metal decreases below the optimum pouring temperature. The time period during which the heating is suspended should be such as not to cause the molten metal to solidify. After the heating suspension period lapses, the molten metal, which has come to have a uniform structure, is heated again and is poured into the die at a time suitable for pouring. The same procedure is taken when a metal piece with an oxide film on it is melted together with a metal piece without an oxide film thereon.

Temperature detecting means may be provided for detecting the temperature of the molten metal in the melting vessel. The control unit judges whether or not the metal in the melting vessel has melted, on the basis of an output signal of the temperature detecting means, and causes the heating means to suspend its operation at a first time point which is a first predetermined time after the control unit judges that the metal in the melting vessel is melted. The control unit causes the heating mean to resume its operation at a second time point, which is a second predetermined time after the first time point. Then, the control unit causes the molten metal in the melting vessel to be poured into the die at a time which is a third predetermined time after the control unit judges, on the basis of the output signal of the temperature detecting means, that the molten metal in the melting vessel attains a predetermined temperature.

First, second and third timers may be used to measure the first, second and third predetermined times. The first timer, measuring the first predetermined time, starts measurement when the control unit judges, on the basis of the output signal of the temperature detecting means, that the metal placed in the melting vessel has been melted. The second timer for measuring the second predetermined time starts measurement at the first time point at which the first timer has measured the first predetermined time. The third timer starts measurement at a time which is later than the second time point and at which the control unit judges that the molten metal in the melting vessel attains the predetermined temperature.

With the above-described arrangement, by continuously melting metal pieces for the first predetermined time after a smaller piece of metal, for example, has been melted, melting of a larger piece of metal advances, too, so that the molten metal mass resulting from the smaller metal piece and the molten metal mass resulting from the larger metal pieces can be mixed into a single mass of molten metal. The temperature of the molten metal as a whole at this stage may be highly probably higher than the temperature suitable for the molten metal to be poured into the die. Accordingly, the heating, of the molten metal is suspended for the second predetermined time to decrease the temperature of the molten metal to a temperature lower than the optimum pouring temperature. The second predetermined time should be such a time period as not to cause the molten metal to re-solidify due to the suspension of the heating for the second predetermined time. Then, the heating is started again to heat the molten metal until the optimum pouring time, which is a time when the third predetermined time from the time when the entire molten metal has been judged to have attained a predetermined temperature, lapses. Then, the molten metal is poured into the die.

The first predetermined time may be longer than the third predetermined time.

The heating means may be one which inductively heats metal with a high-frequency signal modulated with a low-frequency signal. In this case, light-receiving means is used, which receives light emitted by the metal in the melting vessel and develops a received-light representative signal. The control unit causes the heating means to suspend its operation at the first time point which is the first predetermined time after a modulation component based on the modulation with the low-frequency signal begins to appear in the received-light representative signal. Then, the control unit causes the heating means to resume its operation at the second time point which is the second predetermined time after the first time point. The heating operation is continued until the end of the third predetermined time from the time at which the modulation component starts appearing again in the received-light representative signal, and, then, the molten metal in the melting vessel is poured into a die.

Since the metal in the melting vessel is inductively heated with a high-frequency signal modulated with a low-frequency signal, at least part of the metal in the vessel, when melted, starts vibrating due to the low-frequency signal. The vibrations of the molten metal causes a vibrating component to appear in the received-light representative signal developed by the light-receiving means. The heating of the metal is continued for the first predetermined time after the detection of the vibrating component in the received-light representative signal so that the entire metal in the vessel melts and is stirred due to the vibrations so that masses of molten metal resulting from different-sized metal pieces or from different compositions can be mixed into a single mass of molten metal. After that, the heating is suspended for the second predetermined time so that the temperature of the molten metal can decrease below the optimum pouring temperature of the molten metal. After that, the heating is started again and continued for the third predetermined time until the vibrating component re-appears in the received-light representative signal, so that it becomes the optimum pouring time for pouring the molten metal into the die.

DETAILED DESCRIPTION OF THE EMBODIMENT

Figure 1:
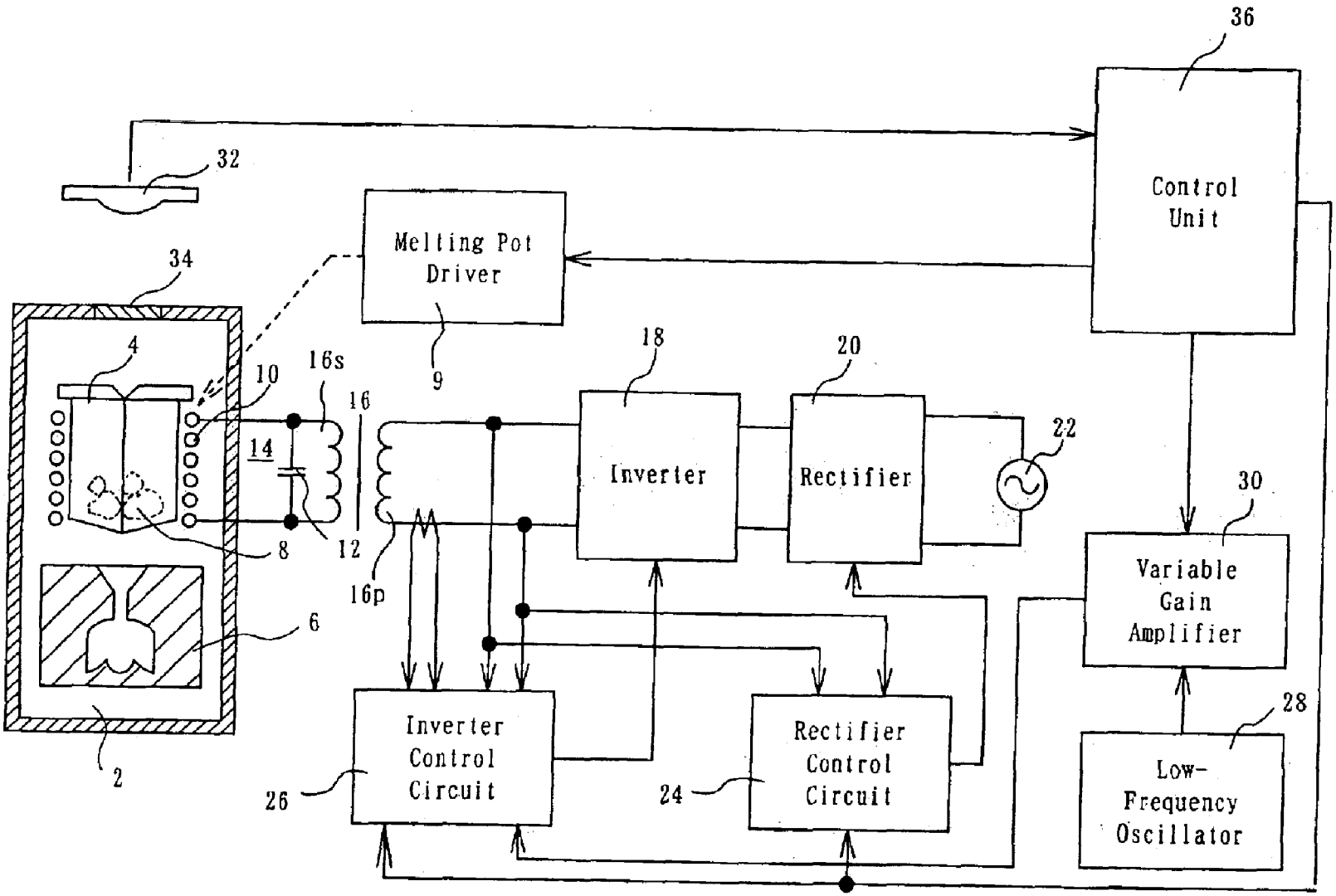
FIG. 1 is a schematic circuit diagram of a casting apparatus according to one embodiment of the present invention.

The present invention may be embodied in, for example, a precision casting apparatus for casting a false tooth. The casting apparatus includes a chamber 2, as shown in FIG. 1. In an upper portion of the chamber 2, disposed is a melting vessel, e.g. a melting pot 4. A die 6 is positioned beneath the melting pot 4. The die 6 is for casting, for example, a false tooth, and has a gate opening toward the melting pot 4. The melting pot 4 is formed of two halves having vertically extending mating surfaces. When a piece or pieces of metal 8 in the melting pot 4 has been melted, the lower ends of the two halves of the melting pot 4 are opened by a melting pot driver 9 so that the molten metal can be poured into the die 6. The arrangement for opening and closing the melting pot 4 is known, and, therefore, detailed description of it is not given.

Heating means, e.g. a high-frequency induction heating coil 10 is disposed in association with the melting pot 4. The coil 10 is disposed around the melting pot 4. The coil 10 is connected in parallel with a resonant capacitor 12 to form a tank circuit 14.

The tank circuit 14 is connected to a secondary winding 16*s* of a matching transformer 16 whose primary winding 16*p* is connected to an output of driving means for driving the tank circuit 14. The driving means may be, for example, a high-frequency induction heating inverter 18.

The inverter 18 has a plurality of semiconductor switching devices, e.g. thyristors, IGBTs, power FETs or power bipolar transistors. The semiconductor switching devices operate to switch at a high frequency to convert a DC voltage supplied thereto from a power supply, e.g. DC output controlled rectifying circuit 20, coupled in the input side of the inverter 18 into a high-frequency signal and apply it to the matching transformer 16.

The rectifying circuit 20 is connected to a commercial AC power supply, for example. The rectifying circuit 20 includes a rectifying and smoothing circuit for rectifying and smoothing the commercial AC voltage, and semiconductor switching devices similar to those of the inverter 18.

The semiconductor switching devices of the rectifying circuit 20 are controlled by a rectifier control circuit 24 in such a manner that a DC voltage of a predetermined value can be supplied to the inverter 18. The rectifier control circuit 24 detects an output voltage of the inverter 18 and controls the semiconductor switching devices in such a manner as to make the output voltage of the inverter 18 have a predetermined value. In other words, the inverter 18 is constant-voltage controlled by the rectifier control circuit 24 and the rectifying circuit 20.

The semiconductor switching devices of the inverter 18 are controlled by an inverter control circuit 26. The inverter control circuit 26 detects the phases of the output voltage and current of the inverter 18 and controls the switching frequency of the semiconductor switching devices of the inverter 18 in such a manner as to make the output frequency of the inverter 18 coincide with the resonant frequency of the tank circuit 14.

The inverter control circuit 26 receives a low-frequency signal supplied from a low-frequency oscillation circuit 28 and amplified by a variable gain amplifier 30.

As described above, the inverter control circuit 26 performs such a control as to make the output frequency of the inverter 18 coincide with the resonant frequency of the tank circuit 14 so that the resonant current of the tank circuit 14 can have a maximum value. The low-frequency signal, however, produces a small phase difference between the output voltage and output current of the inverter 18, which causes the output frequency of the inverter 18 to differ slightly from the resonant frequency of the tank circuit 14, which, in turn, results in decrease of the resonant current of the tank circuit 14. The phase coincident state and the phase non-coincident state are periodically provided by the low-frequency signal, which means that the magnitude of the resonant current of the tank circuit 14 is amplitude-modulated with the low-frequency signal. The metal 8 in the melting pot 4 is heated with the amplitude-modulated resonant current, and, therefore, when the metal 8 melts and becomes spherical in shape due to surface tension, the molten metal 8 vibrates at the frequency of the low-frequency signal. This causes the shape of the sphere of the molten metal to change.

The frequency of the low-frequency signal may be one of various frequencies. In the illustrated embodiment, this frequency is about 10 Hz. Also, one of various waveforms, such as a sinusoidal waveform and a rectangular waveform, can be employed. It should be noted that too high the frequency of the low-frequency signal would produce little vibrations in the molten metal, which are difficult to detect. Optimum shape, magnitude and frequency of the modulating low-frequency signal are dependent on the metal 8 and factors including the sizes and shapes of pieces of metal 8 to be placed in the melting pot 4, and the size and shape of the melting pot 4, but they should be determined to be effective for a wider variety of metals and a wider varieties of the shapes and sizes of the metal pieces.

In order to prevent variations in the output voltage of the inverter 18 due to the amplitude modulation from affecting the constant-voltage control provided by the rectifier control circuit 24, the response of the constant-voltage control by the rectifier control circuit 24 is slow relative to the period of the low-frequency signal.

A temperature detector is disposed outside and above the chamber 2, for detecting the temperature of the metal 8 in the melting pot 4. The temperature detector may be, for example, a light-receiver 32. The light-receiver 32 may be, for example, an infrared photosensor or a pyroelectric sensor. The light-receiver 32 receives light which is emitted by the metal 8 being heated and passes through a window 34 in the top portion of the chamber 2 and develops a received-light representative signal which represents the amount of the received light. The light-receiver 32 is arranged to receive light mainly emanating from a specific location in the melting pot 4.

As the metal 8 is heated, its temperature rises. The amount of light emitted by the metal 8 increases in proportion to the temperature rise. The light-receiver 32 outputs a received-light representative signal which indicates the increase of the amount of light. The received-light representative signal is applied to a control unit 36 including ,control means, for example, a CPU. As the shape of the molten metal 8 changes as described above, a vibrating component appears in the received-light representative signal. The control unit 36 controls the rectifier control circuit 24, the inverter control circuit 26, the variable-gain amplifier 30, and the melting pot driver 9.

Figure 2:
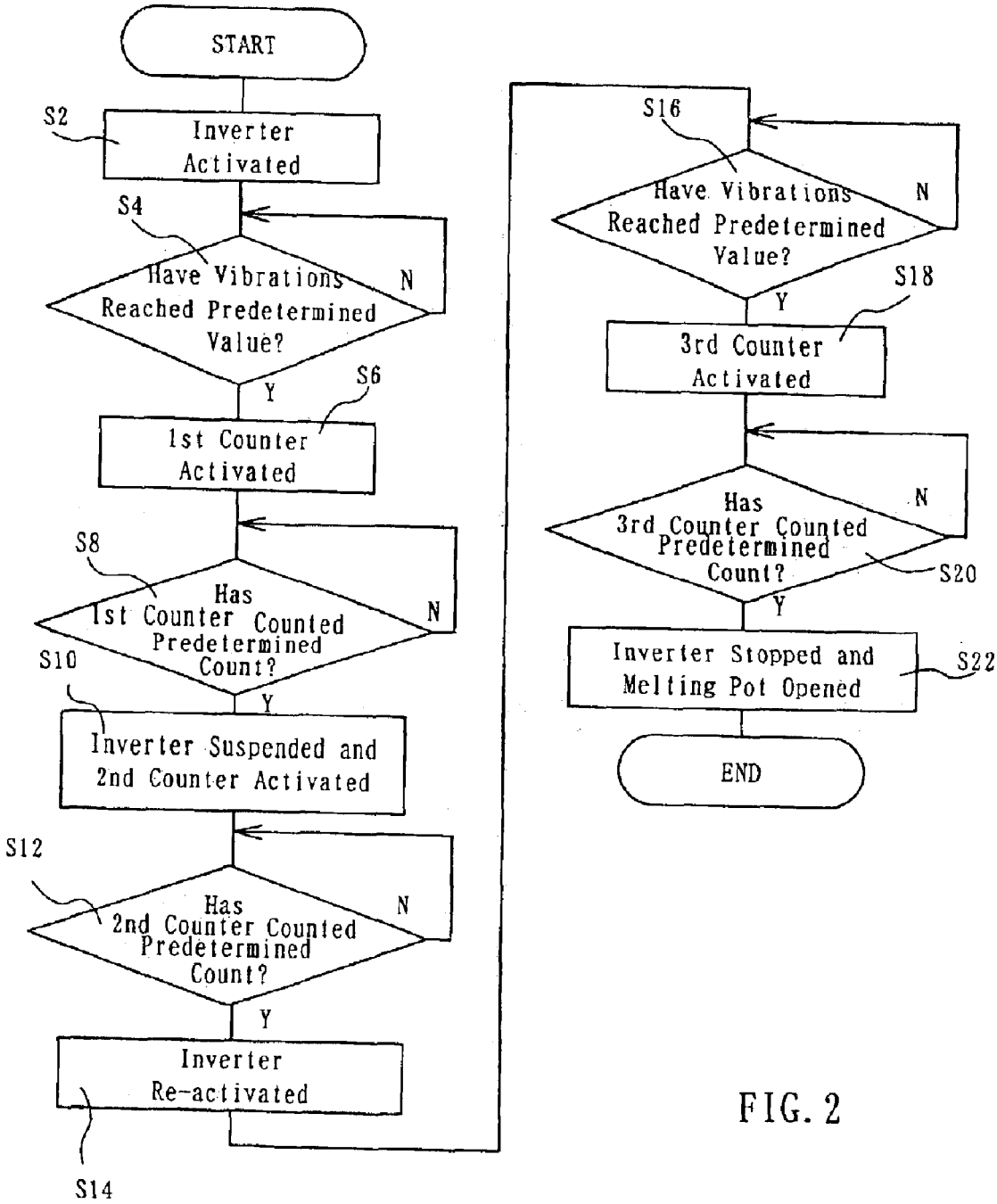
FIG. 2 is a flow chart for use in explaining operation of the casting apparatus shown in FIG. 1.

Operation of the precision casting apparatus is described with reference to FIGS. 2 and 3. A START signal, not shown, is applied to the control unit 36 at a time t0, which activates the inverter 18 (Step S2), and the high-frequency induction heating of the metal 8 in the melting pot 4 starts. In other words, the control unit 36 activates the inverter control circuit 26 and the rectifier control circuit 24. The control unit 36 also sets the gain of the variable-gain amplifier 30 to a predetermined value to thereby apply a low-frequency signal having a predetermined amplitude to the inverter control circuit 26, which activates the inverter 18.

Figure 3:
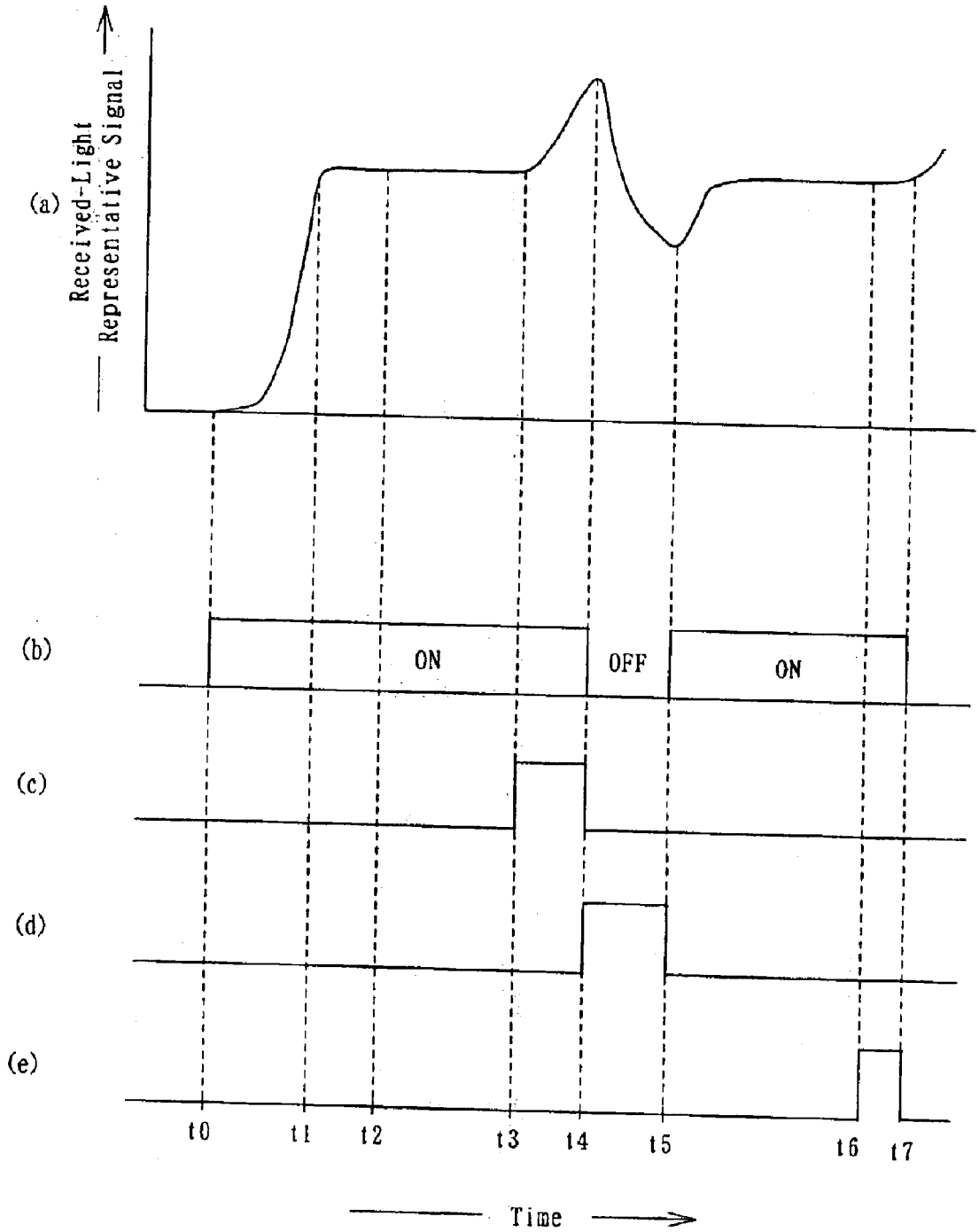
FIGS. 3(*a*) through 3(*e*) show various timings in the casting apparatus shown in FIG. 1.

FIG. 3(*a*) shows the received-light representative signal outputted by the light-receiver 32. Immediately after the time t0 at which the heating starts, rise in temperature of the metal 8 is small and, therefore, the received-light representative signal hardly changes. As the heating continues, the temperature of the metal 8 increases rapidly, and the metal 8 becomes red-hot. At a time t1 immediately before the metal 8 starts melting, the temperature rise becomes gradual, and, therefore, the increase of the magnitude of the received-light representative signal also becomes gradual. At a time t2, a melting period starts. During the melting period, the metal 8 is melted and liquefied from its outer portion. Then, the surface tension of the liquefied portions of the metal 8 increases, and the liquefied portions become to have a spherical surface. Since the high-frequency signal has been modulated with the low-frequency signal, the molten or liquefied metal portions start vibrating at the frequency of the low-frequency signal. Thus, the molten metal portions are stirred. As the melting advances, the amplitude of the vibrations of the molten metal portions increases. If the metal 8 placed in the melting pot 4 consists of metal pieces of different sizes, a smaller piece is melted earlier than larger ones.

Although not shown, the vibrations are reflected on the received-light representative signal. Before the time t2, the metal is not liquefied, and, therefore, the metal does not vibrate. Accordingly, the received-light representative signal contains no vibrating components.

The received-light representative signal is applied to the control unit 36, and the control unit 36 makes a judgment as to whether the magnitude of vibrations of the molten metal has reached a predetermined value (Step S4). In other words, whether the melting of the metal has progressed to a predetermined state or not is judged. The judgment is continued until the vibration magnitude attains the predetermined value.

The control unit 36 may have vibrating component extracting means for extracting the vibrating component from the received-light representative signal. The extracting means may be, for example, a filter. In the control unit 36, an output signal from the filter is converted into a DC signal by DC converting means, e.g. a rectifying and smoothing circuit. In the control unit 36, the DC signal is then compared with a predetermined reference signal in comparing means, e.g. a comparator. If the DC signal is larger than the reference signal, the comparator develops an output signal, which indicates that the magnitude of the vibrations of the molten metal attains the predetermined value.

Let it be assumed that the amplitude of the vibrations of the molten metal reaches the predetermined value at a time t3. Then, the control unit 36 causes a built-in first timer, e.g. a first counter, to start its operation, as shown in FIG. 3(*c*) (Step S6), and makes a judgment as to whether or not the count in the first counter reaches a value corresponding to a first predetermined time (Step S8). The judgment is continued until the first predetermined time lapses. Before the first predetermined time lapses, the inverter 18 continues to operate to heat the metal. Accordingly, high-frequency power continues to be supplied to the molten metal so that all of metal masses with and without an oxide film thereon and all of different sized metal masses can melt. Then, the molten metal starts boiling, which results in rapid increase of the magnitude of the received-light representative signal after a time t3, as shown in FIG. 3(*a*).

When the first counter counts a predetermined count at a time t4, for example, or, in other words, when the molten metal has boiled for a predetermined time, the control unit 36 provides such control on the inverter control circuit 26, the rectifier control circuit 24 and the variable-gain amplifier 30 that the operation of the inverter 18 can be suspended, as shown in FIG. 3(*b*) and a second timer built in the control unit 36, which may be a second counter, can start counting as shown in FIG. 3(*d*) (Step S10). When the molten metal boils, all of metal masses with and without oxide films on their surfaces and metal masses of different sizes are melted and blended completely, and a uniform temperature distribution over the entire molten metal is attained.

When the inverter 18 stops operation at a time t4, for example, as shown in FIG. 3(*b*), the high-frequency power is no longer supplied to the molten metal, which results in decrease of the temperature of the molten metal. As the molten metal temperature decreases, the magnitude of the received-light representative signal also decreases, as shown in FIG. 3(*a*). Further, the shape of the molten metal changes from spherical to flat. Thus, the suspension of operation of the inverter 18 lowers the temperature of the molten metal, which has been raised too much higher than the optimum pouring temperature in order to uniformly melt different sized metal masses or metal masses with and without an oxide film thereon.

When the second counter counts a predetermined count, or, in other words, if the answer to the query made in Step S12 is YES, the molten metal will be at a temperature lower than the optimum pouring temperature. Therefore, as shown FIG. 3(*b*), the inverter 18 is re-activated at a time t5 through the control by the control unit 36 of the inverter control circuit 26, the rectifier control circuit 24 and the variable-gain amplifier 30 (Step S14). The molten metal in the melting pot is heated again, accordingly, to melt and the molten metal assumes a spherical shape. Since the high-frequency signal is modulated with the low-frequency signal, the molten metal vibrates.

Whether or not the magnitude of the vibrations of the molten metal attains a predetermined value is judged in a manner similar to the above-described one (Step S16), and the judgment in Step S16 is continued until the answer to the query changes to YES. Changing of the answer to the query in Step S16 to YES means that the molten metal, which had its temperature lowered, has become suitable for pouring. Then, a third built-in timer, e.g. a third counter, of the control unit 36 is activated at a time t6 as shown in FIG. 3(*e*). Then, judgment is made as to whether or not the third counter has counted a count corresponding to a third predetermined time (Step S20). This judgment is repeated until the answer to the query in Step S20 becomes YES. Until the third counter counts the predetermined count, the high-frequency power is continuously applied to the molten metal, so that the entire molten metal has a uniform temperature distribution and a uniform viscosity.

When the third counter counts the predetermined count at a time t7, so that the answer to the query in Step S20 becomes YES, the inverter control circuit 26, the rectifier control circuit 24 and the variable-gain amplifier 30 are so controlled as to cause the inverter 18 to stop operating, as indicated by the waveform shown in FIG. 3(*b*). At the same time, an OPEN command signal is applied to the melting pot driver 9 to open the melting pot 4. As a result, the lower portions of the two halves of the melting pot 4 are parted so as to pour a spherical mass of the molten metal into the die 6.

The third predetermined time is shorter than the first predetermined time, because the first predetermined time is set for melting uniformly different sized metal pieces or metal pieces with and without oxide films thereon, whereas the third predetermined time is set for raising the temperature of the already melted and mixed metal to the optimum pouring temperature. The determination of the length of the third predetermined time need skill, and, therefore, it should be preferably determined by a dental technician.

It might be possible to stop the inverter 18 at the time t4 so as to let the temperature of the molten metal decrease and to carry out the pouring by determining the pouring temperature based on the received-light representative signal. This, however, is not preferable because the received-light representative signal represents the temperature of only part of the molten metal, and, therefore, if the received-light representative signal indicates the lowering of the temperature to the pouring temperature, it does not necessarily indicates that the entire molten metal has attained the optimum pouring temperature. This is the reason why the molten metal is first cooled to a temperature below the optimum pouring temperature, then heated again to the optimum pouring temperature, while being stirred by the application of the low-frequency signal, and the heating is continued for the third predetermined time after the attainment of the optimum pouring temperature, which is judged from the received-light representative signal, whereby the temperature and viscosity of the entire molten metal can be uniform. Then, the molten metal is poured into the die.

In the described embodiment, metal pieces are melted by means of high-frequency induction heating using an inverter, but any other suitable heating technique, for example, a resistance heating may be employed. Also, the invention has been described as being embodied in a casting apparatus for making false teeth, but it may be used for making small items, such as accessories.

What is claimed is:

1. A casting apparatus comprising:

a melting vessel in which metal is placed;

heating means disposed in association with said melting vessel for heating said metal;

a die into which said metal melted by heating with said heating means is adapted to be poured; and a control unit causing said heating means to continue heating to thereby raise the temperature of the molten metal in said melting vessel for a predetermined first time period after said metal in said melting vessel has been melted by said heating means, then, causing said heating means to suspend operation thereof for a predetermined second time period to lower the temperature of said molten metal, after that, causing said heating means to resume operation to thereby raise the temperature of said molten metal again, then, stopping operation of said heating means, and causing the molten metal in said melting vessel to be poured into said die.

2. The casting apparatus according to claim 1 wherein:

said casting apparatus further comprises temperature detecting means for detecting temperature of the molten metal in said melting vessel; and said control unit judges, on the basis of an output signal developed by said temperature detecting means, when said metal has been melted, said control unit causing said heating means to suspend operation thereof at a first time point which is a first predetermined time after said control unit judges that said metal in said melting vessel has been melted, and causing said heating means to resume operation thereof at a second time point which is a second predetermined time after said first time point, said control unit causing said molten metal in said melting vessel to be poured into said die when a third predetermined time has lapsed from a time at which said molten metal in said melting vessel is judged, on the basis of the output signal of said temperature detecting means, to have attained a predetermined temperature.

3. The casting apparatus according to claim 2 wherein said first predetermined time is longer than said third predetermined time.

4. The casting apparatus according to claim 1 wherein:

said heating means inductively heats said metal with a high-frequency signal modulated with a low-frequency signal;

said casting apparatus further includes light-receiving means receiving light emitted by said metal in said melting vessel and developing a received-light representative signal; and said control unit causes said heating means to suspend operation thereof at a first time point which is first predetermined time after a modulating component due to said low-frequency component begins to appear in said received-light representative signal, causes said heating means to resume operation at a second time point a second predetermined time after said first time point, and causes said metal melted in said melting vessel to be poured into said die a third predetermined time after said modulating component re-appears in said received-light representative signal.

* * * * *